US009988196B2

(12) United States Patent
Glass et al.

(10) Patent No.: US 9,988,196 B2
(45) Date of Patent: Jun. 5, 2018

(54) CARD HOLDER FOR ATTACHMENT TO CONTAINER WALL

(71) Applicant: Gift Card Impressions, LLC, Overland Park, KS (US)

(72) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 0 days. days.

(21) Appl. No.: 13/652,464

(22) Filed: Oct. 15, 2012

(65) Prior Publication Data

US 2013/0277246 A1 Oct. 24, 2013

Related U.S. Application Data

(60) Provisional application No. 61/546,919, filed on Oct. 13, 2011, provisional application No. 61/637,894, filed on Apr. 25, 2012.

(51) Int. Cl.

| | |
|---|---|
| ***B65D 73/00*** | (2006.01) |
| ***B42D 15/00*** | (2006.01) |
| ***G09F 1/00*** | (2006.01) |
| ***G09F 1/10*** | (2006.01) |

(52) U.S. Cl.

CPC ..... *B65D 73/0078* (2013.01); *B42D 15/00* (2013.01); *B65D 73/0064* (2013.01); *G09F 1/00* (2013.01); *G09F 1/10* (2013.01); *G09F 1/103* (2013.01)

(58) Field of Classification Search

CPC .... B65D 85/00; B65D 71/00; B65D 73/0078; B65D 73/0064; A45C 11/18; A45C 11/04

USPC ..... 206/767, 756, 45.24, 464, 232, 470; 40/124, 124.01–124.18

See application file for complete search history.

(56) References Cited

U.S. PATENT DOCUMENTS 1,330,684 A * 2/1920 Chwala ..... G09F 3/18 40/652
1,381,925 A * 6/1921 Lund ..... B42D 5/005 40/661.07
1,473,800 A * 11/1923 Webb ..... G09F 1/02 211/50
1,536,445 A * 5/1925 Maupai ..... G09F 1/04 40/310
1,617,687 A * 2/1927 Munson ..... A63H 3/10 446/151
1,757,964 A * 5/1930 Hurst ..... G09F 3/20 40/652

(Continued)

FOREIGN PATENT DOCUMENTS

WO 2014/106205 A1 7/2014

OTHER PUBLICATIONS

International Search Report and Written Opinion from International Application No. PCT/US2013/078357, dated May 2, 2014; 8 pgs.

*Primary Examiner* — Steven A. Reynolds
(74) *Attorney, Agent, or Firm* — Erise IP, P.A.

(57) ABSTRACT

An assembly for holding a transaction card, such as a gift card, upon the wall of an open-ended container, such as a Christmas stocking or Easter basket, using cooperating inner and outer panels connected to one another via a foldable extension member.

15 Claims, 8 Drawing Sheets

(56) References Cited

U.S. PATENT DOCUMENTS 1,860,380 A * 5/1932 Borregard ..... G09F 1/02 40/312
1,901,661 A * 3/1933 MacCourt ..... G09F 13/14 40/539
1,903,461 A 4/1933 Keller
2,043,209 A * 6/1936 Eisner ..... G09F 1/06 2/206
2,101,683 A * 12/1937 Leigh ..... G09F 1/06 248/456
2,135,830 A * 11/1938 Neher ..... G09F 1/04 40/310
2,144,512 A * 1/1939 Schwartz ..... G09F 1/06 40/539
2,335,609 A * 11/1943 Plowe ..... G09F 1/08 40/539
2,414,559 A * 1/1947 Rochlus ..... G09F 1/04 40/539
2,573,625 A * 10/1951 Swart ..... F03D 3/0436 40/421
2,630,914 A 3/1953 Bekoff
2,748,527 A 6/1956 Seals
2,884,738 A * 5/1959 Lohnes ..... B42D 15/04 40/124.08
3,031,121 A 4/1962 Chase
3,056,377 A * 10/1962 Nelson ..... B60Q 7/005 116/173
3,231,994 A * 2/1966 Cyrus ..... 116/63 P
3,335,467 A * 8/1967 Freed ..... B42F 1/006 24/332
3,380,575 A * 4/1968 Hennessey ..... B65D 5/4204 206/45.25
3,427,642 A * 2/1969 Mohr ..... B42D 15/042 40/124.08
3,590,506 A * 7/1971 Jeski ..... B60Q 7/005 116/28 R
3,664,049 A * 5/1972 Smith ..... B42D 15/04 206/805
3,814,303 A * 6/1974 Smith ..... 229/117.18
4,019,632 A * 4/1977 Greenlee ..... 206/349
4,023,763 A * 5/1977 Pulley ..... G09F 1/10 116/240
4,044,485 A * 8/1977 Hopp ..... G09F 7/08 40/324
4,167,073 A * 9/1979 Tang ..... G09F 3/204 40/584
4,235,032 A * 11/1980 Robinson ..... G09F 1/08 40/539
4,308,986 A * 1/1982 Parrilli ..... 206/470
4,309,839 A * 1/1982 White ..... A63H 3/38 446/152
4,713,899 A * 12/1987 Fast ..... G09F 3/20 211/57.1
4,774,780 A * 10/1988 Crowell ..... G09F 1/06 40/124.08
4,784,314 A * 11/1988 Penick ..... B65D 5/4258 206/457
4,829,689 A * 5/1989 Alshooler ..... G09F 1/10 24/295
4,832,301 A * 5/1989 Hiramoto et al. ..... 248/691
4,833,802 A * 5/1989 Volkert ..... G09F 1/06 40/124.08
4,937,963 A * 7/1990 Barnes ..... 40/661.06
5,001,853 A * 3/1991 Odien ..... G09F 3/04 206/475
5,042,684 A 8/1991 West et al.
5,055,084 A * 10/1991 Jokic ..... A63H 13/16 40/539
5,143,279 A * 9/1992 Gaines ..... B42D 15/045 229/68.1
5,165,800 A 11/1992 Downey
5,303,819 A * 4/1994 Goldberg ..... 206/83
5,344,004 A * 9/1994 Meyer ..... 206/45.25
5,367,807 A * 11/1994 Van Beek ..... G09F 7/22 40/606.14
5,467,547 A * 11/1995 Fortner ..... G09F 1/12 40/539
5,560,492 A * 10/1996 Eren ..... 206/756
5,593,025 A * 1/1997 Feibelman ..... 206/6.1
5,609,253 A * 3/1997 Goade, Sr. ..... B65D 75/30 206/449
5,613,312 A * 3/1997 Crowell ..... 40/312
5,613,602 A * 3/1997 Lage ..... G09F 3/20 206/232
5,664,682 A * 9/1997 Eren ..... 206/756
5,682,999 A 11/1997 Larson
5,713,472 A * 2/1998 Howell et al. ..... 206/784
D396,055 S * 7/1998 Ritchey ..... D19/29
5,813,596 A * 9/1998 Dahlquist ..... G09F 7/06 229/92.3
6,024,277 A * 2/2000 Martin ..... 229/71
6,030,274 A * 2/2000 Kaplan ..... 446/369
D432,583 S * 10/2000 Zalon ..... D20/41
6,457,649 B1 * 10/2002 Hileman ..... 235/486
6,471,053 B1 * 10/2002 Feibelman ..... 206/6.1
6,510,636 B1 * 1/2003 Abramson ..... G09F 3/20 40/642.02
6,554,131 B1 * 4/2003 Findle et al. ..... 206/296
6,609,693 B2 * 8/2003 Hui ..... 248/489
6,619,480 B2 * 9/2003 Smith ..... B65D 73/0078 206/454
6,647,697 B1 * 11/2003 Zarrow ..... B65D 33/14 206/461
7,097,042 B2 * 8/2006 Hsu ..... 206/751
D532,452 S * 11/2006 Heng ..... D19/7
7,219,829 B2 * 5/2007 Treat ..... 229/92.8
D556,600 S * 12/2007 Galantai et al. ..... D9/722
7,308,741 B1 12/2007 Rydberg et al.
7,673,752 B2 * 3/2010 Levy ..... 206/528
D622,763 S * 8/2010 Lamm et al. ..... D19/9
D623,948 S * 9/2010 Levy ..... D9/457
8,696,203 B2 4/2014 Rednour et al.
2002/0100797 A1 * 8/2002 Hollingsworth et al. ... 229/92.8
2003/0024970 A1 * 2/2003 Lonergan ..... A47G 1/143 229/92.8
2003/0205489 A1 * 11/2003 Shumake et al. ..... 206/224
2003/0217949 A1 * 11/2003 Schamante ..... 206/705
2004/0001654 A1 1/2004 Kondo
2004/0045859 A1 * 3/2004 Favale ..... 206/471
2004/0093773 A1 * 5/2004 Clark ..... B42D 15/045 40/124.06
2004/0159571 A1 * 8/2004 Fagen et al. ..... 206/461
2005/0173603 A1 * 8/2005 Dusenberry ..... G09F 23/08 248/213.2
2005/0252810 A1 11/2005 Zind
2005/0258060 A1 * 11/2005 Katz ..... B65D 85/548 206/425
2006/0042986 A1 * 3/2006 Simkowski ..... 206/470
2006/0065748 A1 * 3/2006 Halbur ..... G09F 7/04 235/493
2008/0037907 A1 2/2008 Suskind
2008/0098628 A1 * 5/2008 Geitner ..... G09F 1/06 40/124.06
2009/0100731 A1 * 4/2009 Elvin ..... 40/655
2010/0018090 A1 * 1/2010 Dickert ..... B42D 5/027 40/124.08
2012/0205281 A1 8/2012 Glass et al.
2013/0233751 A1 * 9/2013 Hansen et al. ..... 206/464

* cited by examiner

CARD HOLDER FOR ATTACHMENT TO CONTAINER WALL

CROSS REFERENCE TO RELATED APPLICATIONS

This application claims the benefit of the prior-filed, provisional applications, Ser. No. 61/546,919, filed Oct. 13, 2011, and Ser. No. 61/637,894, filed Apr. 25, 2012, incorporated by reference herein.

BACKGROUND OF THE INVENTION

This invention relates generally to transaction card holders and more particularly to a device for holding a transaction card, such as a gift card, upon the upper margin of the wall of a container, such as a Christmas stocking or Easter basket. The holder is held to the container wall by gripping the upper margin of the container wall between the main body of the holder and one or more extension structures.

Transaction cards, stored value cards, or gift cards as they are commonly called based upon their intended use, have become popular gifts. Gift cards typically comprise a stored value card whereby a certain cash equivalent value is associated with a code or data stored upon a magnetic strip applied to the surface of the card. This stored value may be determined by the vendor prior to packaging and display for sale or is selected at the point of sale by the purchaser and loaded using a magnetic card reader/writer. While popular, gift cards are typically provided with a generic and impersonal design, typically identifying the associated merchant for which the card may be used to purchase merchandise and, therefore, are not personalized in view of the intended recipient.

Gift cards given as Christmas gift and placed within a Christmas stocking suffer a further disadvantage in that, due to their relatively small size, they often fall to the bottom of the stocking and can become somewhat of an afterthought as they are often located by the gift recipient long after the initial excitement of acquiring more prominently placed gifts within the stocking. Since the monetary value of the gift card may well exceed that of other gifts placed within the stocking, a gift giver may find it desirable that the gift card be placed in a more prominent location, while not detracting from the decorative aspects of a Christmas stocking, so that it may receive a more enthusiastic reception from the gift recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet.

Presently, the above requirements pertain to approximately 95% of all gift cards and gift card packets that are sold at retail.

What is needed, therefore, is a device that displays a gift card for purchase when hung upon a display rack within a predetermined and allotted display space but that also engages with the upper margin of a Christmas stocking to convert the gift card to a decorative element and to place the gift card in a more prominent location.

BRIEF DESCRIPTION OF THE INVENTION

The purpose of this invention is to provide a card holder for holding a transaction card, such as a gift card, upon the upper margin of a container, such as a Christmas stocking, Easter basket or other open-top structure. The card holder may include a main body for positioning inside the container and extension structures that extend over the upper margin of the container and downward along the outer surface of the container wall to mount and hold the holder upon the upper margin of the container wall with the lower portion of the main body within the container and between the container walls.

Another embodiment of the card holder may include an inner panel, upon which a transaction card may be removably mounted or attached, and an outer panel, both panels typically being in an upright and vertical position when the holder is on display for sale. The outer panel overlies and is attached to the inner panel via a collapsible extension member. When the extension member is closed, folded or collapsed, the holder is also thereby closed, folded or collapsed so that the overall front to back dimension of the holder is reduced and the holder may readily be inserted into an envelope or hung for display when on sale. When the holder is placed in an unfolded or open position it may be mounted upon the wall of a container, such as an open top holiday container, such as a Christmas stocking or an Easter basket. The extension member and holder are in a fully open position when the angles between all adjoining extension member panels are at approximately 90 degrees. The extension member, and in particular the horizontal extension member panels, are sized to span the width of the container wall.

To mount the holder upon a container, the inner panel is positioned inside the container and adjacent to the inner surface of the container wall. The outer panel is positioned outside the container and adjacent to the outer surface of the container wall. The extension member, and in particular the lower horizontal extension member panel, rests upon the upper surface or margin of the wall. The holder therefore spans the container wall and the inner and outer panels securely hold the enclosed portion of the wall between them to securely but removably mount the holder to the container. While the extension member is appropriately sized so that the holder can accommodate the thickness of the container wall, the extension member need not be exactly proportioned since the portions of the inner and outer panels that project below their attachment points with the extension member are able to flex outward to accept a wall dimension that is somewhat greater than that of the extension member.

An embodiment of the holder may include a relative planar main body and an extension structure projecting downward from an attachment point with the main body to lie generally parallel to the main body. The main body includes means for attaching a transaction card to the main body, such as spaced slits or removable adhesive. A lower portion of the main body is inserted into an open container and the extension structure extends outside of the open container to capture a wall of the container between the main body and the extension structure.

Another embodiment of the holder includes an inner panel and an opposing outer panel, spaced apart from one another to receive a wall of a container therebetween. A foldable extension member is positioned between the inner panel and outer panel and connects these panels to one another to form a unitary body. Either the inner panel or outer panel includes means for retaining a gift card upon a surface thereof.

A hang tag extends from one of the panels and may be removable from such panel by tearing along a line of perforations.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
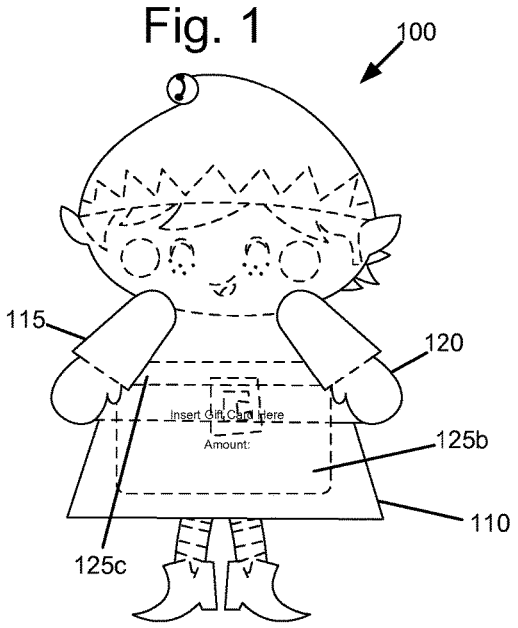
FIG. 1 is a front elevation of a card holder.
Figure 2:
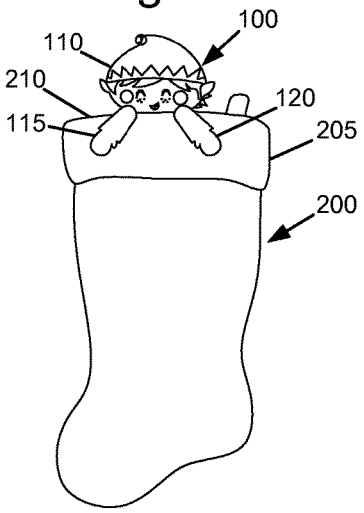
FIG. 2 is a front elevation showing the card holder installed upon a Christmas stocking.

With reference to the figures, FIGS. 1-6 are illustration of one or more embodiments of a card holder 100 for holding a transaction card, such as a gift card 105. FIG. 1 is a front elevation of a card holder 100 showing a main body 110 comprising substantially planar card stock, or material with similar properties, and having a figurine design, in this case a figurine of a Christmas elf. FIG. 2 shows a holder 100 having the design of a Santa Claus figurine. It should be appreciated that designs corresponding to various holidays or other events, whether figurines or other structures, may be practiced according to the present invention.

A first, left extension structure 115 is attached at a proximate, upper end thereof to a first attachment point of the main body 110 and projects downward at a transversely outward (as shown, leftward) angle to lie generally parallel to the plane of the main body 110. A second, right extension structure 120 is attached at a proximate, upper end thereof to a second attachment point of the main body 110 and projects downward at a transversely outward (as shown, rightward) angle to lie generally parallel to the plane of the main body 110. In addition to graphical decorations and designs that may be provided on the main body 110 or extension structures 115 and 120, the main body 110 may include a graphic design and/or text indicating proper positioning of a gift card 105 thereon.

Figure 3:
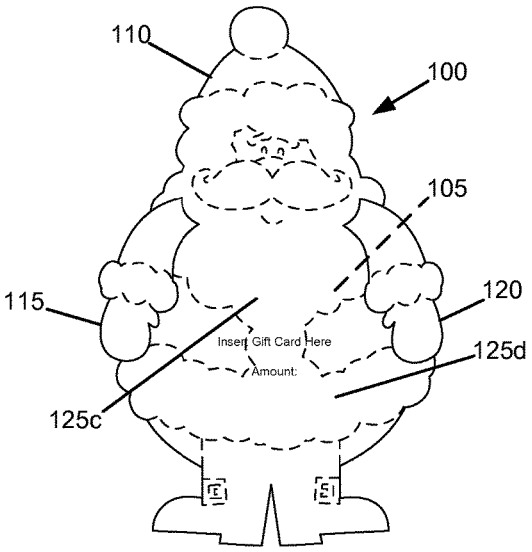
FIG. 3 is a front elevation of an alternative embodiment of a card holder.

As shown in FIG. 1, diagonal slits 125*a* and 125*b* in the main body 110 are sized and positioned to accept diagonally opposing corners of a gift card 105 to attach the gift card 105 to the holder 100. Alternatively, slits in other locations on the main body 110, and in other dimensions, may be used. FIG. 3 shows slits 125*c* and 125*d* proximate the top and bottom margins, respectively, of a gift card 105 positioned upon the main body 110. The top edge of a gift card 105 is positioned within slit 125*c* and the bottom edge of the gift card 105 is positioned within slit 125*d* to securely hold the gift card 105 to the holder 100. In FIG. 3 the location and positioning of a gift card 105 is indicated in phantom lines.

Figure 4:
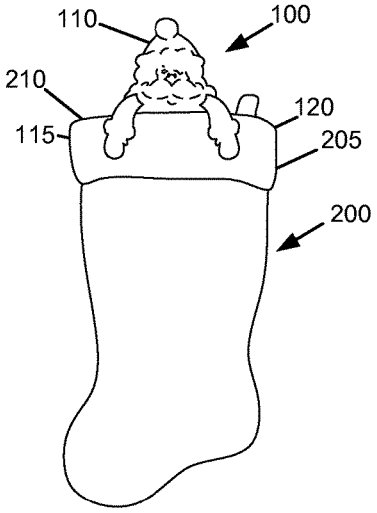
FIG. 4 is a front elevation showing the card holder installed upon a Christmas stocking.

FIG. 2 is a front elevation showing the card holder 100 of FIG. 1 installed upon a Christmas stocking 200. FIG. 4 is a front elevation showing the card holder 100 of FIG. 3 installed upon a Christmas stocking 200. As shown in each of these two figures, the lower portion of the main body 100, including the portion bearing a gift card 105, is positioned within the stocking 200 so that it is obscured by the stocking walls 205. The upper portion of the holder 100 projects upward from the upper margin 210 of the stocking 200 so that it may be observed and serve to increase excitement and anticipation in the recipient of the gift card 105. The extension structures 115 and 120, designed and decorated to appear as figurine arms in the illustrated embodiments, slide over the outside of the walls 205 to retain the holder 100 in the desired illustrated position.

Figure 5:
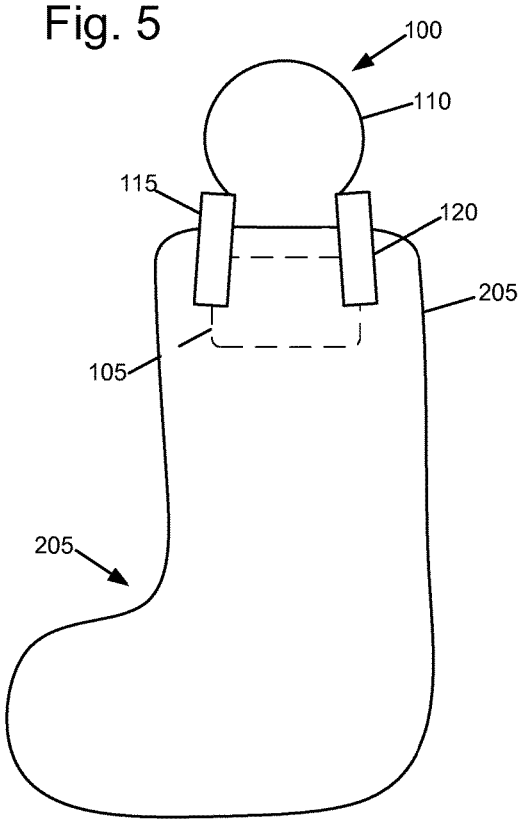
FIG. 5 is a front elevational diagram of the card holder installed upon a Christmas stocking.
Figure 6:
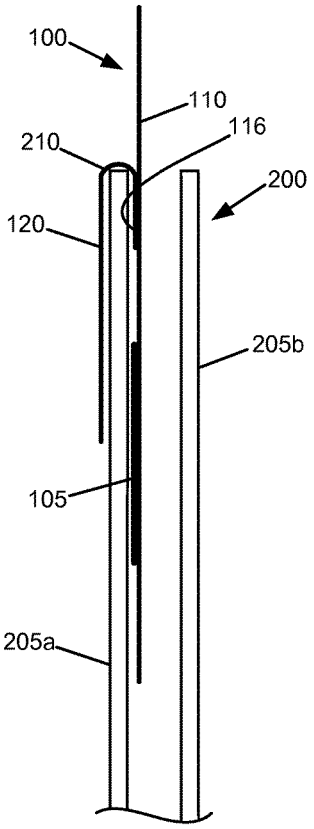
FIG. 6 is a side, cross sectional diagram of the card holder installed upon an open-ended container.

FIG. 5 is a front elevational diagram of the card holder 100 installed upon a Christmas stocking 200. A gift card 105, attached to the main body 110 of the holder 100 and positioned inside the stocking 200 with the lower portion of the main body 110 to which it is attached, is shown in phantom lines. FIG. 6 is a side, cross sectional diagram of the card holder 100 installed upon an open-ended container, such as a Christmas stocking 200, so that the extension structures (120 is shown) extend over the upper margin 210 of the stocking 200 and downward along the outer surface of the proximate stocking wall 205*a* to hold the holder 100 upon the upper margin 210 with the lower portion of the main body 110 between the stocking walls 205*a* and 205*b*.

The extension structures 115 and 120 may be formed separately from the main body 110 and attached to the main body 110 during assembly of the holder 100 by adhering a section 116 of each extension structure to the main body 110 so that the remaining, unadhered portion of each extension structure projects outward and then downward in a direction generally parallel to the main body 110, as shown in FIG. 6. Alternatively, an extension structure may be formed of two or more sub-structures, such as a first structure attached to the main body 110 so that it projects over the upper margin 210, and a second structure attached to the first structure so that it projects downward and generally parallel to the main body 110.

Figure 7:
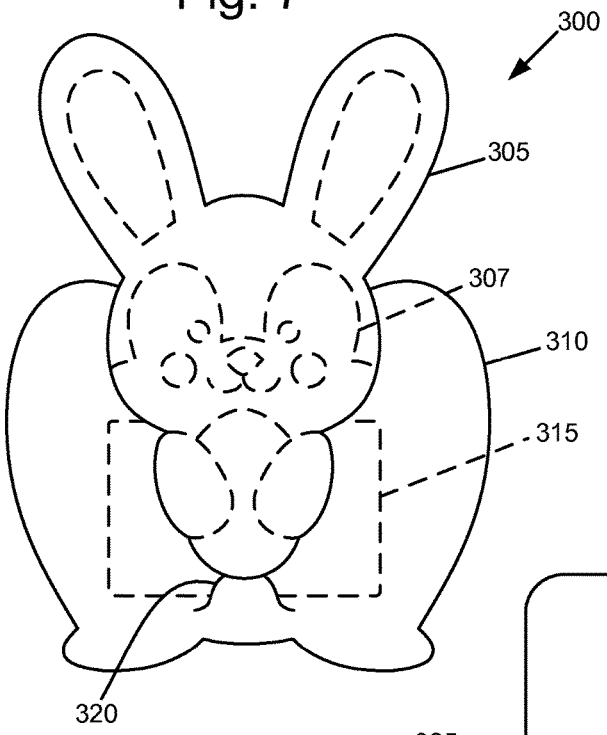
FIG. 7 is a front elevation of an alternative embodiment of a card holder.

FIGS. 7-20 are illustrations of one or more further embodiments of a card holder 300 for holding a transaction card, such as a gift card 105. FIG. 7 is a front elevation of an alternative embodiment of a card holder 300. The particular design shown is that of a rabbit to correspond to an Easter holiday theme, however, it should be appreciated that the embodiments of card holder shown herein may take any number of forms and designs corresponding to various holidays or other events or themes. The card holder 300 comprises an outer panel 305 and an inner panel 310 connected to one another but spaced apart when in use. One of the panels, typically the inner panel 310 (as shown), includes means for holding a card, such as a gift card 105 or other transaction card, thereon. In the present embodiment, slits 320 in the inner panel 310 hold a card so that it may be retained upon the inner panel 310, yet readily removed. The slits 320 may take various forms, but as shown in FIGS. 7-21 each slit 320 is shaped to create a tab structure. A pair of cooperating slits 320 and tab structures hold a card in a position upon the inner panel 310 as indicated by phantom lines 315.

Figure 8:
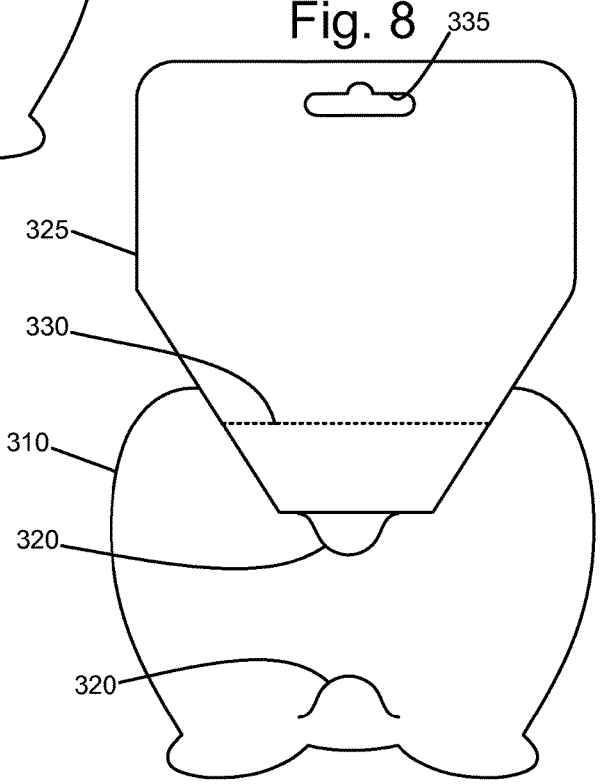
FIG. 8 is a rear elevation of the card holder shown in FIG. 7 including detachable hang tag.
Figure 9:
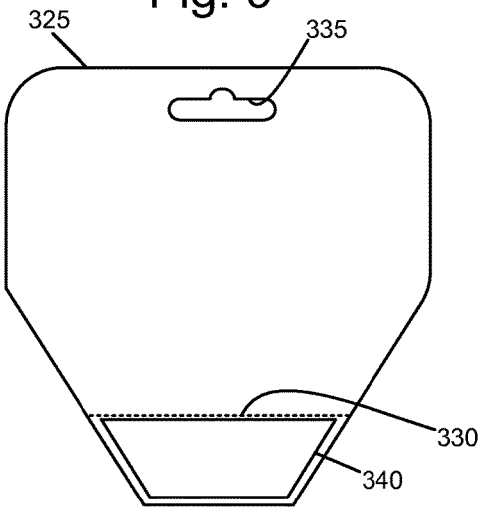
FIG. 9 is a front elevation of a hang tag.

FIG. 8 is a rear elevation of the card holder 300 shown in FIG. 7 including detachable hang tag 325. The hang tag 325 is attached to, and extends upwardly from, the upper, rear surface of the inner panel 310, as shown in FIG. 8. The hang tag 325 is typically provided with a hole or aperture 335 for receiving a display stand peg. A line of perforations 330 across the lower portion of the hang tag 325 may be provided to allow the upper portion of the hang tag 325 to be readily detached prior to giving the card holder 300 to a recipient. As an alternative to a perforation line 330, an ink line indicating a suggested location to cut across the hang tag 325 may be printed on the hang tag 325 or, as a further alternative, the hang tag 325 may be attached to the inner panel 310 using removable adhesive. The line of perforations 330 and ink line function as hang tag separation indicators. FIG. 9 shows the front surface of the hang tag 325, including a location where adhesive 340 may be applied to adhere the front surface of the hang tag 325 to the rear surface of the inner panel 310.

Figure 10:
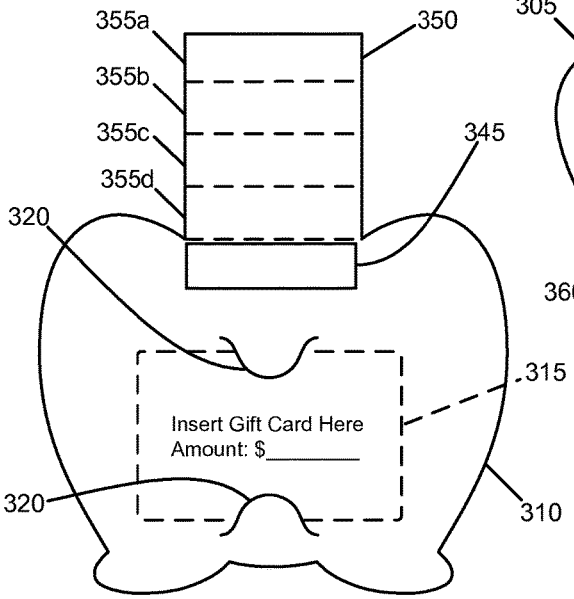
FIG. 10 is a front elevation of the main body or inner panel of a card holder including the unassembled extension member.

FIG. 10 is a front elevation of the main body or inner panel 310 of the card holder 300 including the unassembled extension member 350. The extension member 350 serves to connect or attach the outer panel 305 to the inner panel 310. As shown in the figures, the extension member 350 is collapsible or foldable and may comprise an elongated, hollow, four-sided structure. FIG. 10 shows first surfaces of first, second, third and fourth, extension member 350 panels 355*a*, 355*b*, 355*c* and 355*d*, respectively, all attached to one another along fold lines as indicated in broken lines. Fold lines may be indicated on the extension member 350 via scoring, perforations or printing. To assemble the extension member 350, the panels 355*a*, 355*b*, 355*c* and 355*d* are folded along the fold lines to form an elongated, foldable or collapsible, open-ended box. First panel 355*a* is folded forward to an approximately 90 degree angle relative to second panel 355*b*. Second panel 355*b* is folded forward to an approximately 90 degree angle relative to third panel 355*c*. Third panel 355*c* is folded forward to an approximately 90 degree angle relative to fourth panel 355*d*. Fourth panel 355*d* is folded forward to an approximately 90 degree angle relative to the inner panel 310 so that a second surface of panel 355*a* aligns with and contacts adhesive 345 provided on the upper, front surface of the inner panel 310. As an alternative, adhesive may be provided on the back surface of panel 355*a* for adhering panel 355*a* to the inner panel 310. As also shown in FIG. 10, text or other indicia may be provided to indicate where to locate a gift card 105 between the slits 320. An outline of a gift card may also be provided in phantom lines 315 to indicate proper positioning.

Figure 11:
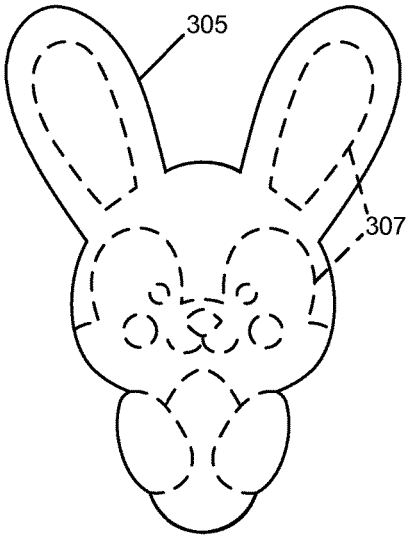
FIG. 11 is a front elevation of an outer panel of a card holder.
Figure 12:
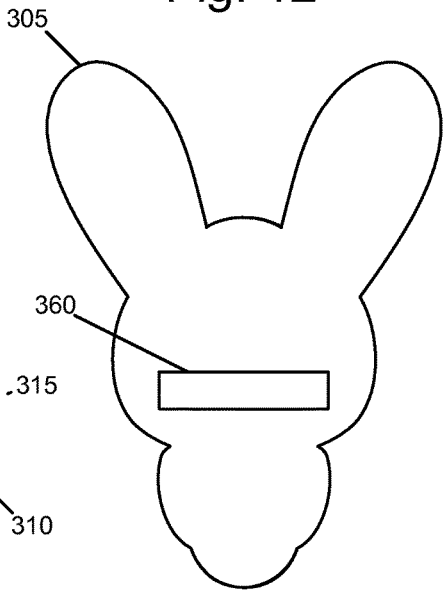
FIG. 12 is a rear elevation of an outer panel of a card holder.

FIG. 11 is a front elevation of an outer panel 305 of a card holder 300. As shown in FIGS. 7 and 11, the panels (e.g. outer panel 305) may bear graphics (shown in phantom lines 307) corresponding to the design or theme of the holder 300. FIG. 12 is a rear elevation of an outer panel 305 of a card holder 300. As shown, adhesive 360 is provided on the rear surface of the outer panel 305 to adhere the outer panel 305 to a second surface of panel 355*c*, thereby adhering the outer panel 305 to the extension member 350.

Figure 13:
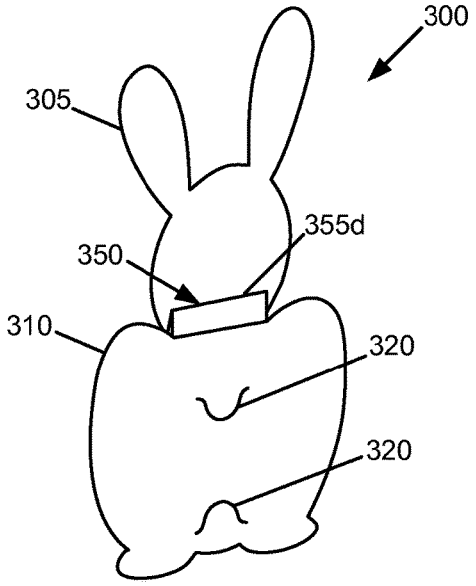
FIG. 13 is a rear perspective view of a card holder showing the card holder and extension member in a folded or closed position.
Figure 14:
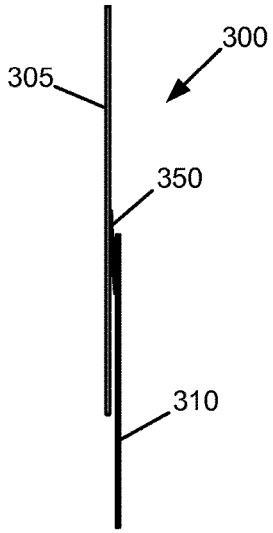
FIG. 14 is a side elevation view of a card holder in a closed or folded position.

The extension member 350 panels 355*a*, 355*b*, 355*c*, 355*d* may tilt, fold or pivot relative to one another along the fold lines therebetween. The extension member 350 may be thereby be placed in a closed, folded or collapsed position when any two adjacent panels, e.g. panels 355*c* and 355*d*, are folded inward upon each other so the first surface of each are proximate to the other and in a substantially vertical disposition. FIG. 13 is a rear perspective view of a card holder 300 showing the card holder 300 and extension member 350 in a substantially folded, collapsed or closed position by folding the extension member 350 along the fold line between 355*c* and 355*d* and along the fold line between 355*a* and 355*b*. As shown in FIG. 14, a side elevation view of a card holder 300 in a closed, collapsed or folded position, folding the extension member 350 along these fold lines effectively raises the outer panel 305 relative to the inner panel 310.

Figure 15:
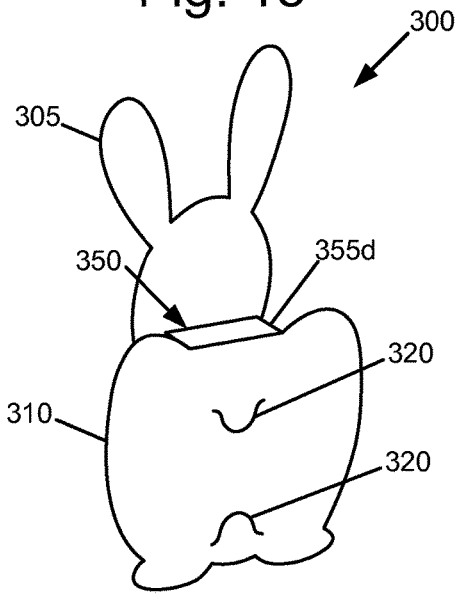
FIG. 15 is a rear perspective view of a card holder showing the card holder and extension member in an unfolded or open position.
Figure 16:
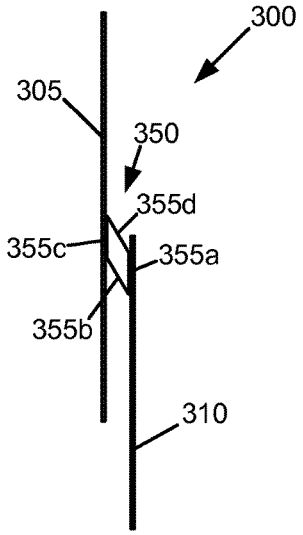
FIG. 16 is a side elevation view of a card holder in a partially unfolded or open position.
Figure 17:
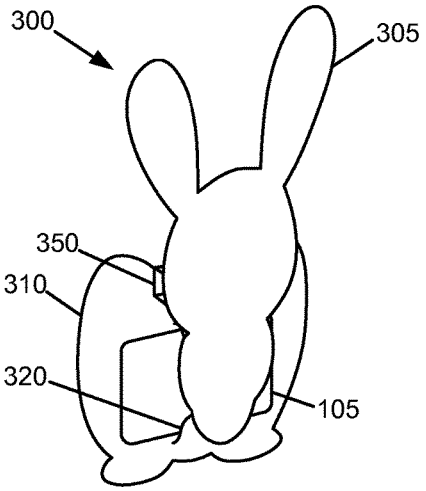
FIG. 17 is a front perspective view of a card holder in an unfolded or open position.

FIG. 15 is a rear perspective view of a card holder 300 showing the card holder 300 and extension member 350 in a substantially unfolded or open position. FIG. 16 is a side elevation view of a card holder 300 in a partially unfolded or open position with the angles between panels 355*c* and 355*c*, and between 355*a* and 355*b*, opening or becoming less acute to approach 90 degrees; and with the angles between panels 355*a* and 355*d*, and between 355*b* and 355*c*, closing or becoming less obtuse to approach 90 degrees. FIG. 17 is a front perspective view of a card holder 300 in an unfolded or open position and showing a transaction card 105 mounted or removably attached thereto.

Figure 19:
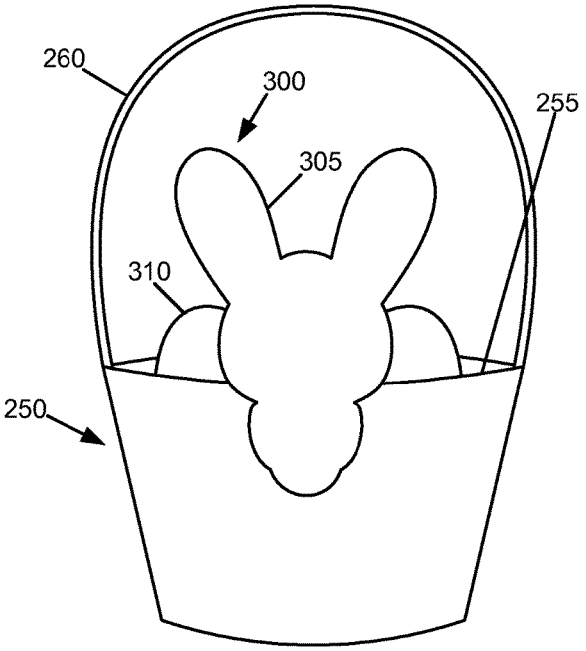
FIG. 19 is a front perspective view of a card holder mounted on the wall of an Easter basket.
Figure 18:
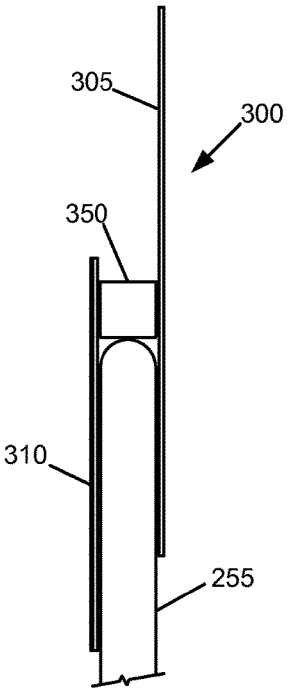
FIG. 18 is a side elevation view of a card holder in an unfolded or open position and mounted upon the wall of an Easter basket.

FIG. 18 is a side elevation view of a card holder 300 in an unfolded or open position and mounted upon the wall 255 of a container, such as an Easter basket 250. The extension member 350 and card holder 300 are in a fully open position with the angles between all extension member panels (355*a*-355*d*) at approximately 90 degrees. The extension member 350, and in particular panels 355*b* and 355*d*, is sized to span the width of the container wall 255. The inner panel 310 is positioned inside the container and adjacent to the inner surface of the wall 255. The outer panel 305 is positioned outside the container and adjacent to the outer surface of the wall 255. The extension member 350, and in particular panel 355*b*, rest upon the upper surface of the wall 255. Not shown in FIG. 18 is the transaction card 105 which is mounted to the front or outward facing surface of the inner panel 310 (see FIG. 17). FIG. 19 is a front, perspective, environmental view of a card holder 300 mounted on the wall 255 of a container 250 comprising a closed wall 255 and a handle 260 attached thereto, such as an Easter basket.

Figure 20:
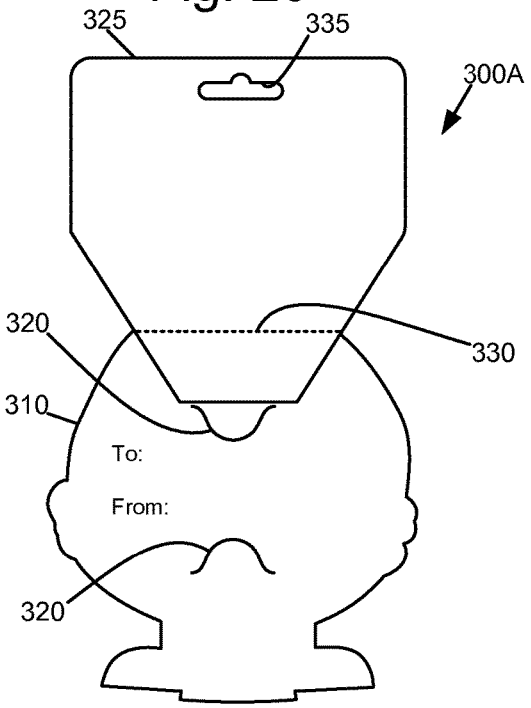
FIG. 20 is a rear perspective view of a card holder showing the hang tag still attached.

FIGS. 20 through 25 illustrate a further embodiment of a card holder 300A substantially similar in structure and function to that of card holder 300 shown in FIGS. 7 through 19, and differing from card holder 300 principally in theme by having the design or form of a Santa figure. FIG. 20 is a rear perspective view of the card holder showing the hang tag 325 attached to the main body or inner panel 310.

Figure 22:
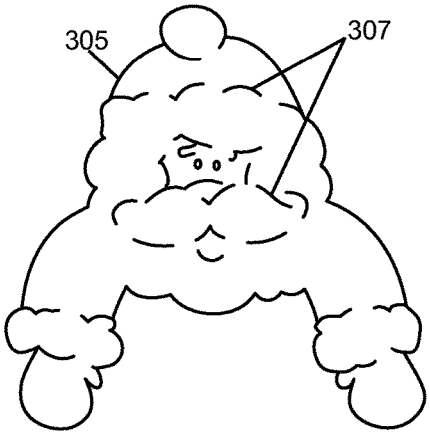
FIG. 22 is a front elevation of an outer panel of a card holder.
Figure 21:
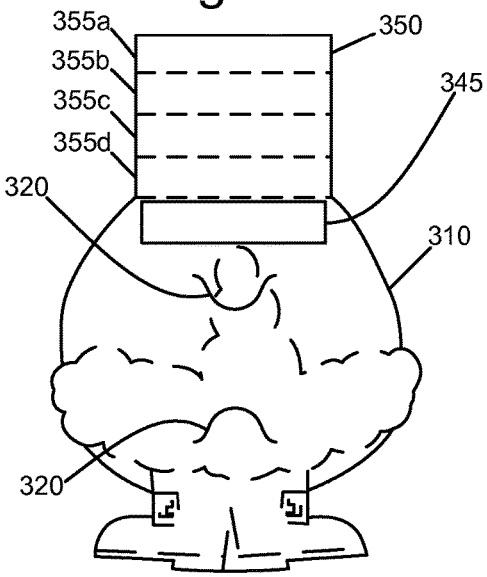
FIG. 21 is a front elevation of the main body or inner panel of a card holder including the unassembled extension member.
Figure 23:
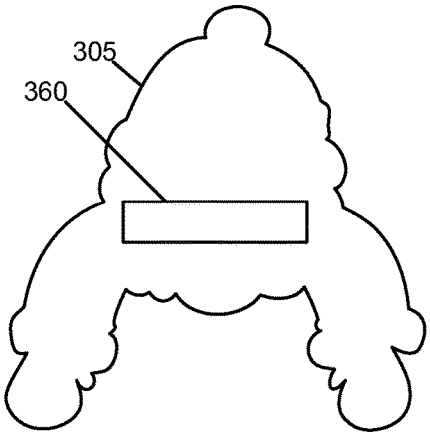
FIG. 23 is a rear elevation of an outer panel of a card holder.

FIG. 21 is a front elevation of the main body or inner panel 310 of a card holder 300A including the unassembled extension member 350. FIG. 22 is a front elevation of an outer panel 305 of a card holder 300A, showing graphic elements that correspond to the design or theme of the holder 300A in phantom lines 307. FIG. 23 is a rear elevation of an outer panel 305 of a card holder 300. As shown, adhesive 360 is provided on the rear surface of the outer panel 305 to adhere the outer panel 305 to a second surface of panel 355*c*, thereby adhering the outer panel 305 to the extension member 350.

Figure 24:
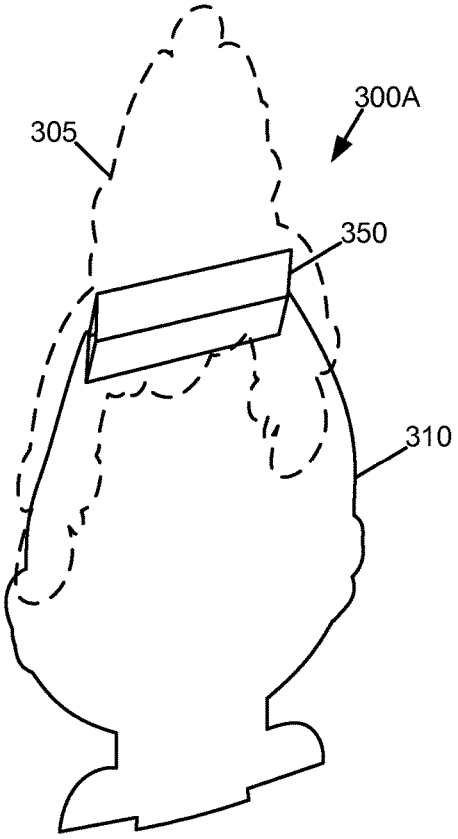
FIG. 24 is a front perspective view of a card holder with the outer panel drawn in phantom lines to show the card holder and extension member in a substantially folded or closed position.
Figure 25:
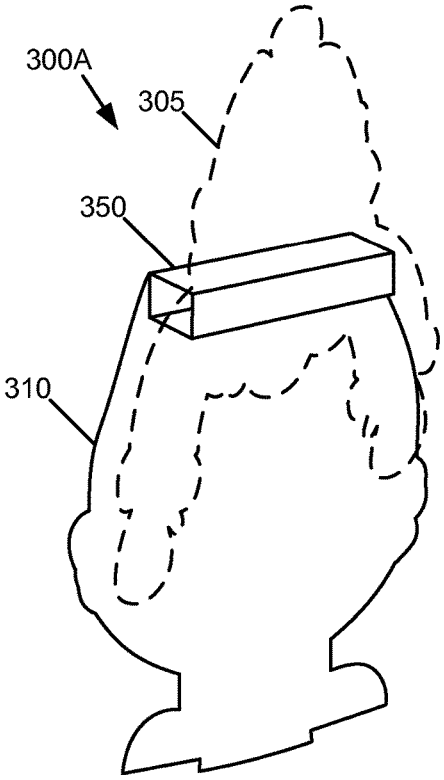
FIG. 25 is a front perspective view of a card holder with the outer panel drawn in phantom lines to show the card holder and extension member in an unfolded or open position.

FIG. 24 is a front perspective view of the card holder 300A with the outer panel 305 drawn in phantom lines to show the card holder 300A and extension member 350 in a substantially folded, collapsed or closed position. FIG. 25 is a front perspective view of the card holder 300A with the outer panel 305 drawn in phantom lines to show the card holder 300A and extension member 350 in an unfolded or open position.

It should be appreciated that the main body 110 or 310, extension structures 115 and 120, and/or outer panel 305 may be constructed in various shapes and forms and bearing various graphics and designs while maintaining the general structure and functionality described herein. Certain embodiments of the holders 100, 300 and 300A and any associated packaging are typically constructed and assembled to comply with standard space constraints for display upon store racks, and more particularly to not exceed 5.25 inches tall by 4 inches wide.

Having thus described the invention, what is claimed as new and desired to be secured by Letters Patent is:

1. A holder for a transaction card comprising:

an inner panel lying in a first plane and an opposing outer panel lying in a second plane, where the inner panel and the outer panel are non-contiguous, where the first plane and the second plane are generally parallel to one another;

a card holder associated with at least one of the inner panel or the outer panel configured to removably retain the transaction card;

an extension member fixedly engaged to a front surface of the inner panel and a back surface of the outer panel, to form a unitary body wherein the inner panel and the outer panel are spaced apart from one another with the extension member disposed therebetween, and wherein a space between the inner panel and the outer panel is sufficient for receiving a container wall in an open configuration;

wherein the extension member is an elongated, hollow, multi-sided structure that comprises a first panel, a second panel, and a third panel, all attached to one another along a plurality of fold lines wherein at least one panel of the extension member, the inner panel, and the outer panel defines a space;

wherein, in an open configuration, the inner and outer panels are generally perpendicular to at least one panel of the extension member, at least one of the inner and outer panels extends both above and below the panels of the extension member, and wherein the space is sufficient for receiving the container wall;

wherein, in a closed configuration, the extension member is collapsed so that the inner panel is disposed proximal to the outer panel of the card holder, such that the space between the inner panel and the outer panel and an overall front to back dimension between a front surface of the outer panel and a back surface of the inner panel is reduced, and such that at least one surface of each of the inner panel and the outer panel is visible in a closed configuration; and a hang tag extending from one of the panels.

2. The holder of claim 1, wherein said hang tag is separable from said panel.

3. The holder of claim 1, wherein said hang tag is separable from said panel along a line of perforations.

4. The holder of claim 1, wherein said hang tag is engaged to at least one of the panels by a removable adhesive.

5. The holder of claim 1, when in an open configuration, the inner panel is spaced apart from the outer panel to receive the container wall in the space between the inner panel and outer panel.

6. The holder of claim 5, wherein the inner panel is disposed proximal to an interior surface of the container wall received in the space between the inner panel and outer panel.

7. The holder of claim 5, wherein the extension member contacts an upper surface of the container wall received in the space between the inner panel and outer panel.

8. The holder of claim 1, wherein the inner panel and the outer panel are generally parallel to one another in both an open configuration and a closed configuration.

9. The holder of claim 1, wherein the extension member comprises a foldable structure having at least two sides.

10. The holder of claim 9, wherein the extension member is an elongated, hollow, four-sided structure.

11. A holder for a transaction card comprising:

an inner panel lying in a first plane and an opposing outer panel lying in a second plane, where the inner panel and the outer panel are non-contiguous, where the first plane and the second plane are generally parallel to one another;

a card holder associated with at least one of the inner panel or the outer panel configured to removably retain the transaction card;

an extension member fixedly engaged to a front surface of the inner panel and a back surface of the outer panel, to form a unitary body wherein the inner panel and the outer panel are spaced apart from one another with the extension member disposed therebetween;

wherein the extension member is an elongated structure that comprises at least one panel, wherein the at least one panel of the extension member, the inner panel, and the outer panel defines a space;

wherein, in an open configuration, the inner panel and outer panel are generally perpendicular to the at least one panel of the extension member, and at least one of the inner and outer panels extends both above and below the at least one panel of the extension member, and wherein the space is sufficient for receiving a container wall;

wherein, in a closed configuration, the extension member is collapsed so that the inner panel is disposed proximal to the outer panel of the card holder, such that the space between the inner panel and the outer panel and an overall front to back dimension between a front surface of the outer panel and a back surface of the inner panel is reduced, and such that at least one surface of each of the inner panel and the outer panel is visible in a closed configuration; and a hang tag extending from one of the panels.

12. The holder of claim 11, wherein the card holder comprises a first slit and a second slit.

13. The holder of claim 11, wherein the card holder is configured to retain the transaction card such that is can be viewed externally from the container wall.

14. The holder of claim 1, wherein the card holder comprises a first slit and a second slit.

15. The holder of claim 1, wherein the card holder is configured to retain the transaction card such that is can be viewed externally from the container wall.

* * * * *